US010258162B2

(12) United States Patent
Lin

(10) Patent No.: US 10,258,162 B2
(45) Date of Patent: Apr. 16, 2019

(54) FOLDABLE CHAIR WITH A METAL SEAT

(71) Applicant: Spec Seats Technologies Inc., Chung-Li (TW)

(72) Inventor: Mei Chuen Lin, Chung-Li (TW)

(73) Assignee: Spec Seats Technologies Inc., Chung-Li (TW)

( * ) Notice: Subject to any disclaimer, the term of this patent is extended or adjusted under 35 U.S.C. 154(b) by 16 days.

(21) Appl. No.: 15/677,523

(22) Filed: Aug. 15, 2017

(65) Prior Publication Data

US 2019/0053625 A1 Feb. 21, 2019

(51) Int. Cl.

| | |
|---|---|
| ***A47C 4/24*** | (2006.01) |
| ***A47C 7/40*** | (2006.01) |
| ***A47C 7/16*** | (2006.01) |
| ***A47C 4/52*** | (2006.01) |

(52) U.S. Cl.

CPC ..... *A47C 4/24* (2013.01); *A47C 4/52* (2013.01); *A47C 7/16* (2013.01); *A47C 7/40* (2013.01)

(58) Field of Classification Search

CPC .... A47C 4/10; A47C 4/14; A47C 4/20; A47C 4/24; A47C 4/52; A47C 7/16; A47C 7/40

See application file for complete search history.

(56) References Cited

U.S. PATENT DOCUMENTS

| | | | | |
|---|---|---|---|---|
| 7,427,099 | B1 * | 9/2008 | Lin | A47C 4/24 297/56 |
| 7,954,891 | B2 * | 6/2011 | Lin | A47C 4/24 297/28 |
| 8,109,564 | B2 * | 2/2012 | Lin | A47C 1/121 297/23 |
| 2011/0084537 | A1 * | 4/2011 | Lin | A47C 4/24 297/452.18 |

* cited by examiner

*Primary Examiner* — Philip F Gabler

(74) *Attorney, Agent, or Firm* — Wang Law Firm, Inc.

(57) ABSTRACT

A foldable chair includes a chair body having two rear legs, a metal seat movable upward and foldable on the rear legs so as to occupy little storage room. When the seat is moved to a seated position and when the rear legs are moved to a stretch-out position, the seat has a bottom edge seated on the top end of the rear legs and defines a straight line aligned with a middle line of the top end of the rear leg. An integrally formed strengthening structure extends across a bottom side of the seat so that gravity center of the seat is concentrated on the top ends of the rear legs, thereby strengthening the supporting ability of the rear legs relative to the seat so that even sitting of an overweight person on the seat does not deform and damage the seat and the rear legs.

8 Claims, 11 Drawing Sheets

FOLDABLE CHAIR WITH A METAL SEAT

BACKGROUND OF THE INVENTION

1. Field of the Invention

The present invention relates generally to a chair, and more particularly a foldable chair with a metal seat.

2. The Prior Arts

A conventional chair includes a first frame and a seat integrally formed with the first frame. It is noted that the first frame and the seat are made from metal and that the seat cannot be folded on the first frame, thereby occupying a relatively large room and hinders the transportation thereof.

Moreover, the conventional chair further includes two rear legs attached to the first frame in such a manner that after assembly and when the conventional chair is in use, top ends of the rear legs support a bottom edge of the seat from below. The seat is rectangular in general and the bottom edge of the seat has two parallel sides seated on the top ends of the rear legs are not always located at the center position of the top ends such that the gravity of a seated person is not be concentrated on the top ends of the rear legs. In other words, the rear legs of the conventional chair may damage if the weight of the seated person is too heavy.

In the abovementioned conventional chair, only the top ends of the rear legs support two parallel sides of the seat, let alone the large dimension of the seat, thereby causing insufficient rigidity of the entire chair. To be more specific, break down or undesired deformation of the conventional chair is still possible whenever over weight person frequently sits on the seat.

SUMMARY OF THE INVENTION

A primary objective of the present invention is to provide a foldable chair with a metal seat and foldable upward and two rear legs foldable relative to two front legs, thereby occupying a relatively small room and facilitating in transportation.

A secondary objective of the present invention is to provide a foldable chair with a metal seat with the gravity weight concentrated on the rear legs, thereby strengthening the rigidity the rear legs such that the configuration or formation does not deform and break up even an over weight person frequently sits on the seat.

Still another objective of the present invention is to provide a foldable chair having a seat with the gravity weight concentrated uniformly on the rear legs, thereby strengthening the rigidity the seat such that the configuration or formation does not deform even an over weight person frequently sits on the seat of the foldable chair of the present invention.

In order to achieve the preceding objective, a foldable chair with a metal seat of the present invention, includes: a chair body, a backrest and a seat made from metal.

The chair body includes a first frame having an inverted U-shaped frame part and two front legs extending from two ends of the inverted U-shaped frame part, and a second frame having two rear legs connected pivotally to inner sides of the two front legs such that the rear legs are foldable relative to the front legs between a stretch-out position, where the front and rear legs are stretched out and a folded position, where the front and rear legs are folded on each other.

The backrest is installed to inner sides of the inverted U-shaped frame part of the first frame.

The seat is connected pivotally to the inner sides of the front legs and movable relative to the first frame between a seated position, where a person can sit thereon, and a storage position, where the seat is folded on the first frame, wherein the top end of the rear leg defines an imaginary middle line extending in the front and rear direction and wherein the seat has a bottom edge with a width (thickness) smaller than that of top end of a respective one of the rear legs such that when the seat is moved to the seated position and once the rear legs are at the stretch-out position, the bottom edge of the seat is seated on the top ends of the rear legs and defines a straight line in alignment with the imaginary middle line of the top end of the rear leg.

Preferably, the bottom edge of the seat extends downward from a periphery confining the seat and has two parallel sides bent inwardly relative to the seat so as to form two curl structures such that when the seat is moved to the seated position and when the rear legs are at the stretch-out position, the curl structures of the seat are seated on the top ends of the rear legs and defining the straight line in alignment with the imaginary middle line of the top end of the rear leg.

The foldable chair of the present invention further includes an integrally-formed strengthening structure and extending transversely between the two parallel sides of the bottom edge of the seat.

The strengthening structure preferably includes a connecting part extending between the two parallel sides of the bottom edge of the seat and located proximate to a front part of the seat, two curved parts extending from two opposite ends of the connecting part and two extension parts extending rearward from the two curved parts into the two curl structures respectively such that the extension parts are located above and within the two curl structures respectively, thereby strengthening rigidity of the seat.

Preferably, the connecting part of the strengthening structure is spaced apart from the front part of the seat by a first distance while a rear part of the seat is spaced apart from the connecting part of the strengthening structure by a second distance, where the first distance is greater than the second distance.

In one embodiment of the present invention, the first distance is equivalent to a quarter of the second distance.

To be more specific, each of the rear legs includes a lower leg support portion, an upper leg support portion disposed on an outer side of the lower leg support portion and extending upwardly therefrom for pivotally connecting with an inner side of a respective one of the front legs, a reinforcing structure disposed on an inner side of the upper leg support portion and having a top end flush with a top end of the upper leg support portion, and a buffering pad enclosing the top ends of the reinforcing structure and the upper leg support portion, thereby defining the top end of the rear leg such that the reinforcing structure and the upper leg support portion are located on both sides of a middle line defined by the buffering pad while an outer side of the reinforcing structure abuts against the inner side of the upper leg support portion such that the middle line of the buffering pad serves as the imaginary middle line of the top end of the rear leg.

Preferably, the first frame further has a position restriction rod connected integrally to the two front legs and two stop stubs connected integrally to the two front legs at inner sides thereof such that when the seat is moved to the seated position and when the rear legs are at the stretch-out position, the lower leg support portion leans against the position restriction rod, and when the seat is moved to the storage position and when the rear legs are moved to the folded position, the bottom edge of the seat and the lower leg support portion simultaneously and perpendicularly abut against the stop stubs of the front legs.

Preferably, the lower leg support portions are formed with two protrusions having two stub grooves respectively for receiving the stop stubs of the front legs.

Preferably, the second frame further includes a connection rod for connecting integrally the two reinforcing structures.

One distinct feature of the present invention resides in that because the seat even though fabricated from metal and can be folded relative the first frame while the rear legs can be folded relative to the front legs, the foldable chair with a metal seat of the present invention occupies a relatively small storage room and facilitates in transportation. In addition, the entire weight of the seat is distributed uniformly on the top ends of the rear legs, which implicitly means that the rigidity of the rear legs is strengthened or increased and at the same time the support quality of the rear legs with respect to the seat is enhanced such that the seat as well as the rear legs will not deformed, varied or break up even if an overweight person frequently sits on the seat.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
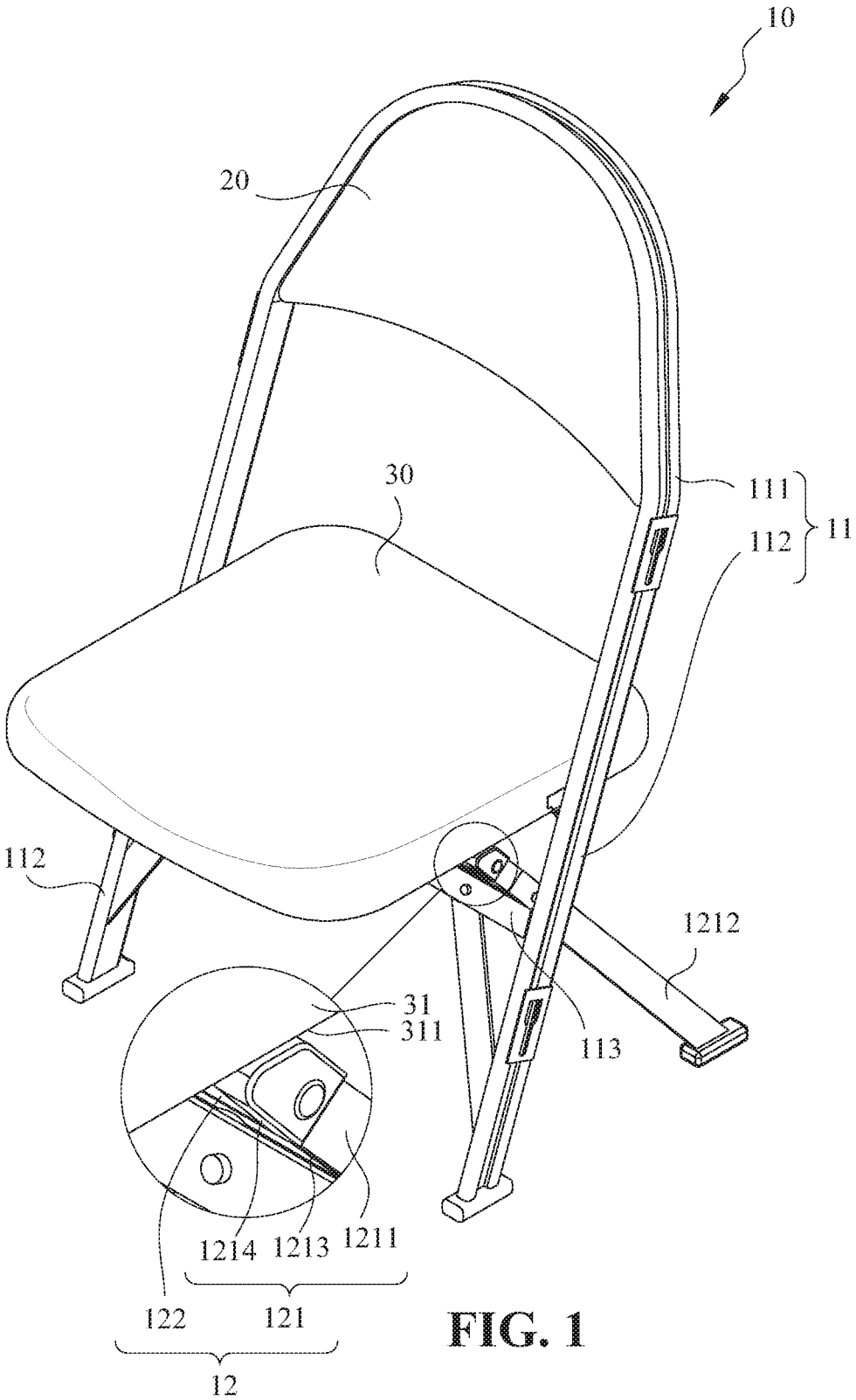
FIG. 1 is a perspective view of a foldable chair with a metal seat of the present invention.
Figure 2:
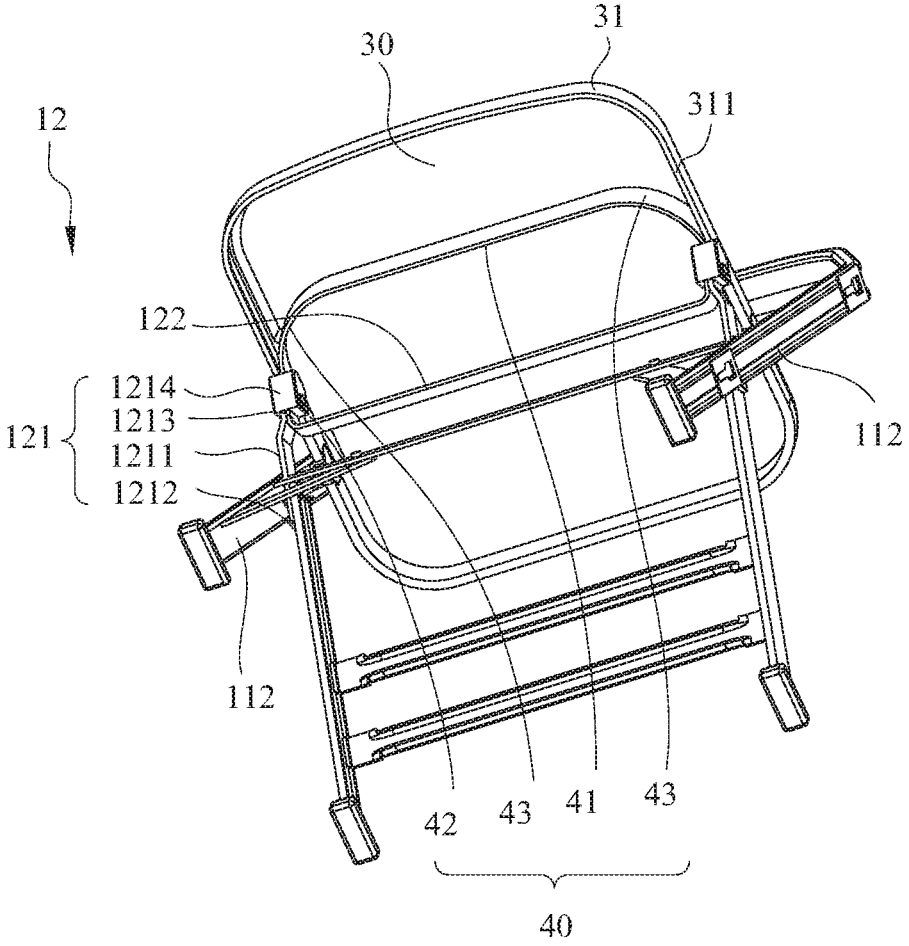
FIG. 2 is a perspective view of the foldable chair with a metal seat of the present invention viewed from another angle.
Figure 3:
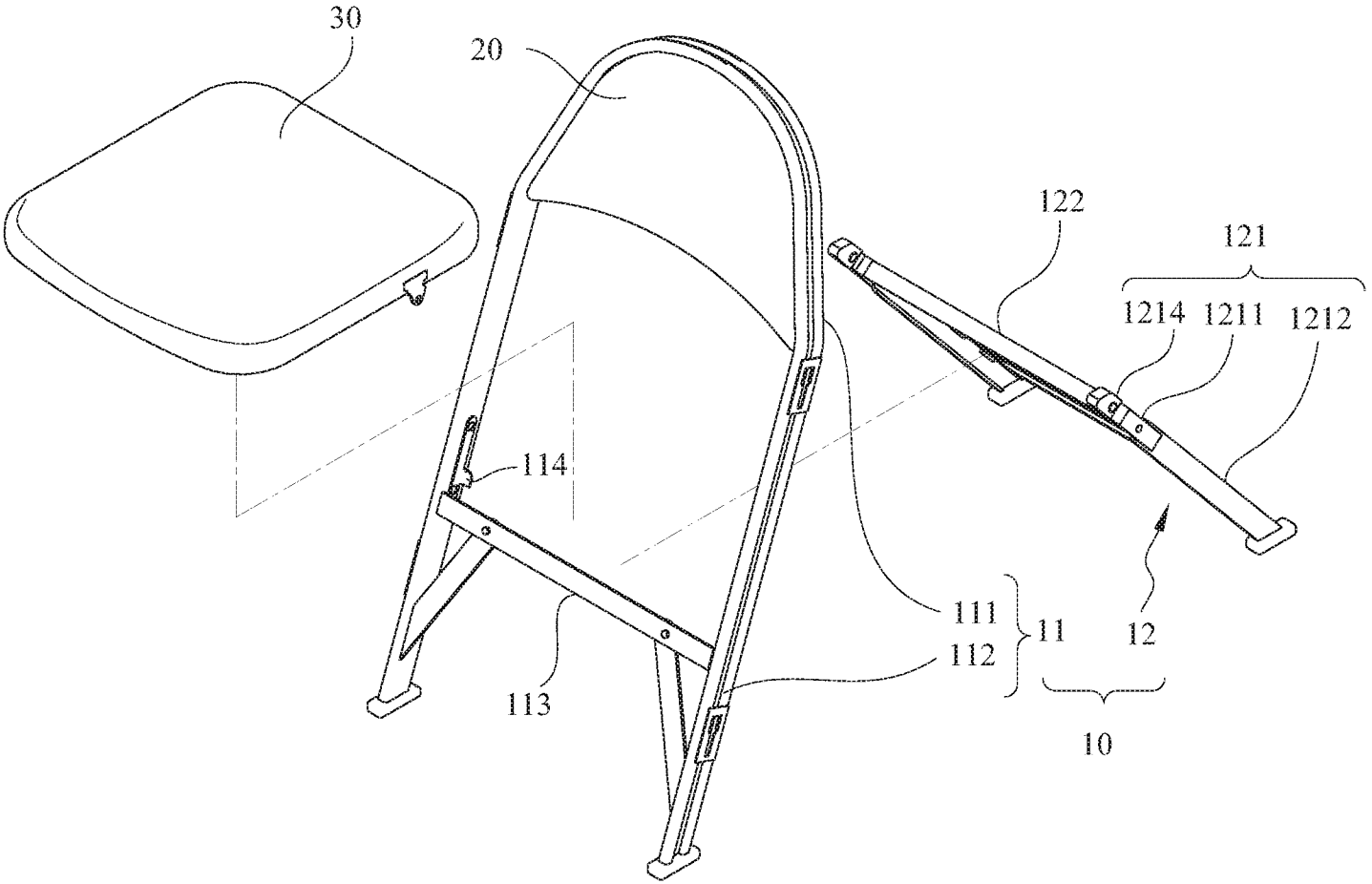
FIG. 3 is an exploded view of the foldable chair with a metal seat of the present invention.
Figure 4:
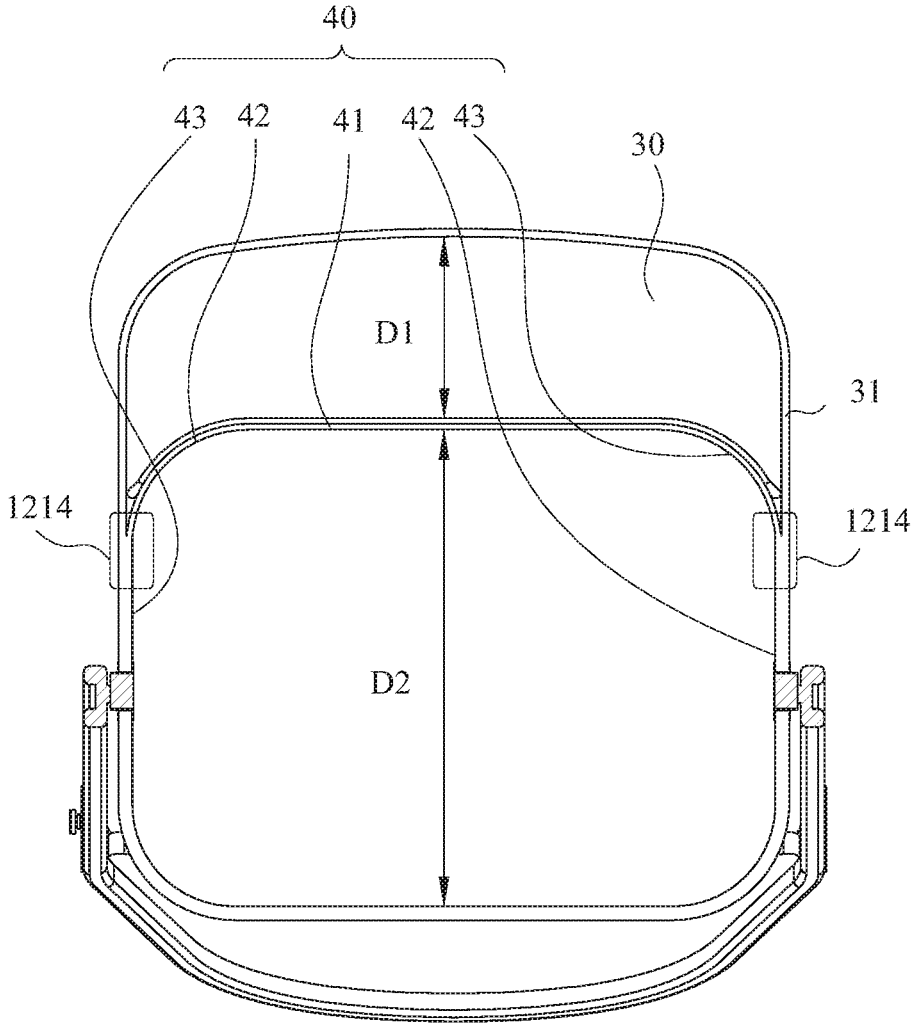
FIG. 4 is a bottom view of the foldable chair with a metal seat of the present invention.
Figure 5A:
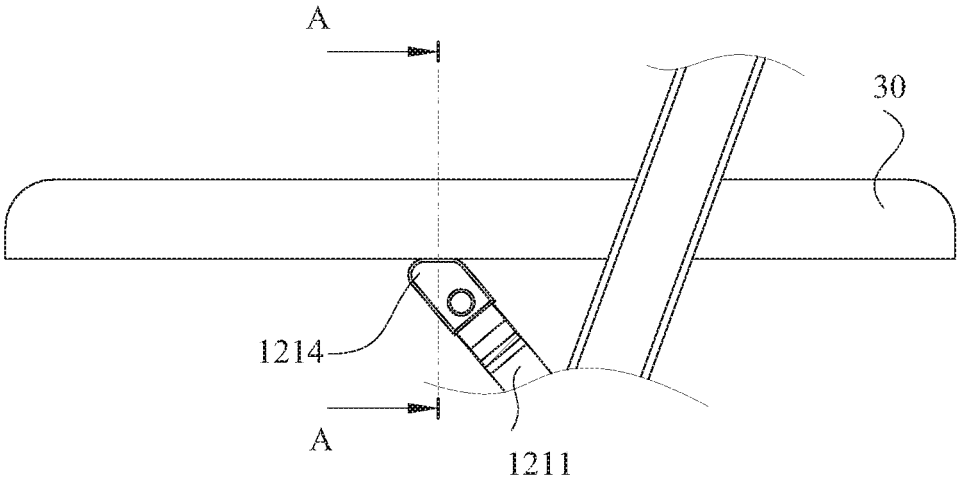
FIG. 5A is a fragmentary side view of the foldable chair with a metal seat of the present invention.
Figure 5B:
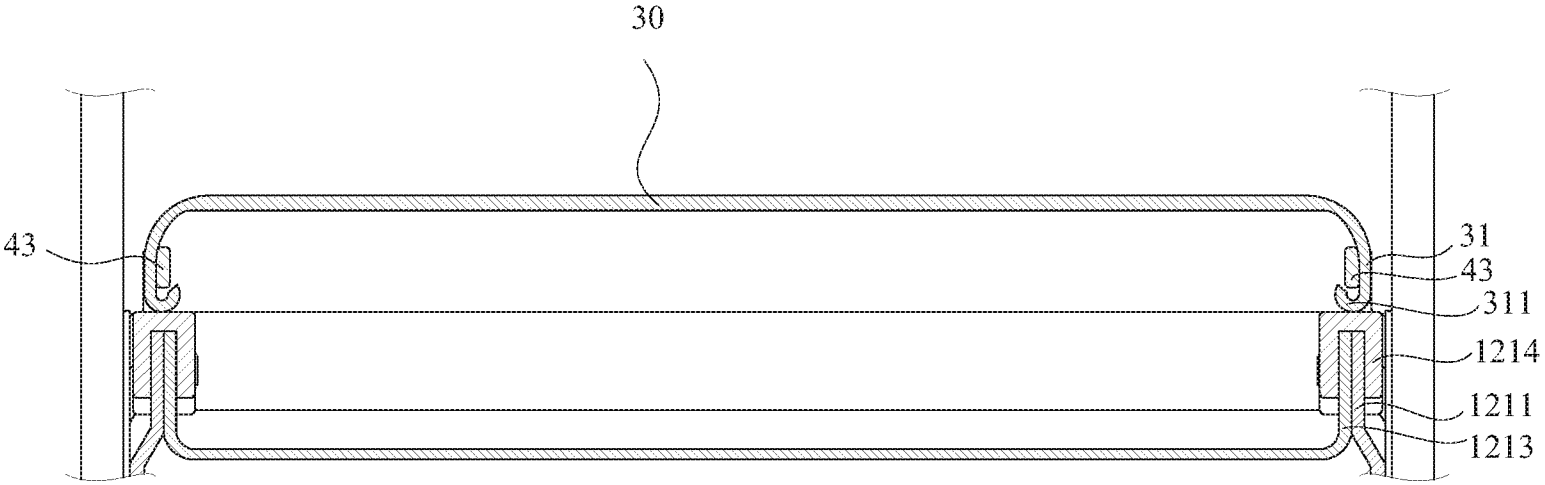
FIG. 5B is a cross section view of the foldable chair with a metal seat of the present invention taken along Line A-A in FIG. 5A.
Figure 6:
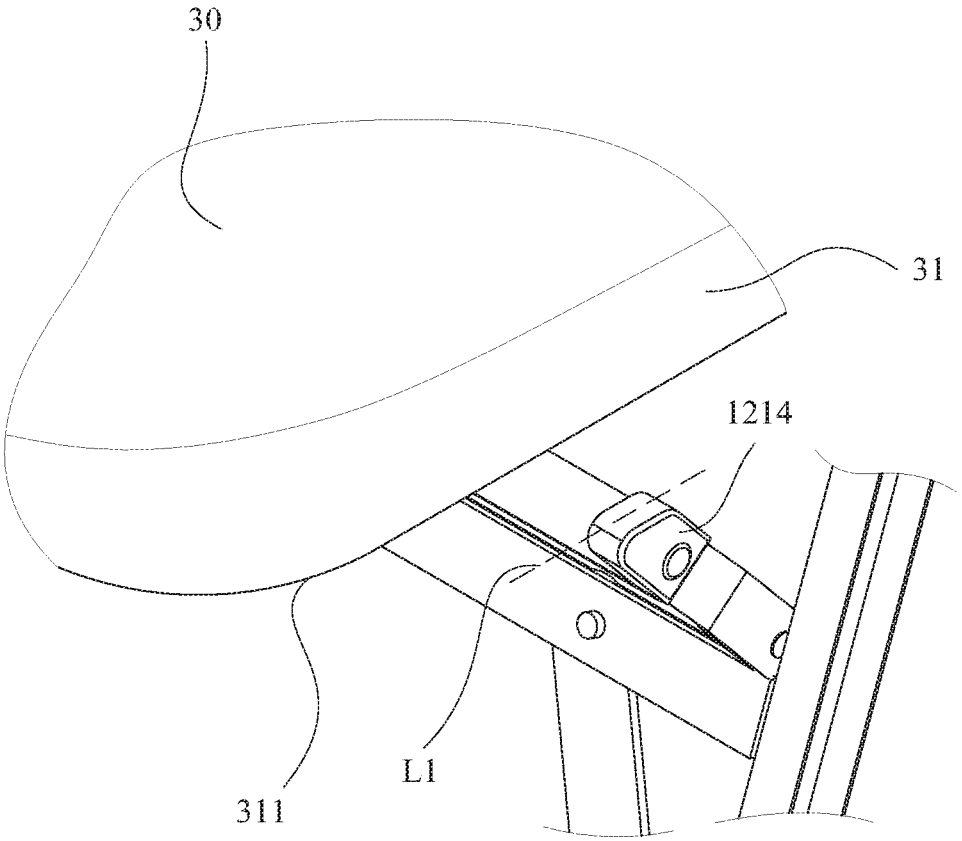
FIG. 6 is a fragmentary view of the foldable chair with a metal seat of the present invention, illustrating the relationship between a bottom edge of a seat and a top end of rear legs employed therein.
Figure 7:
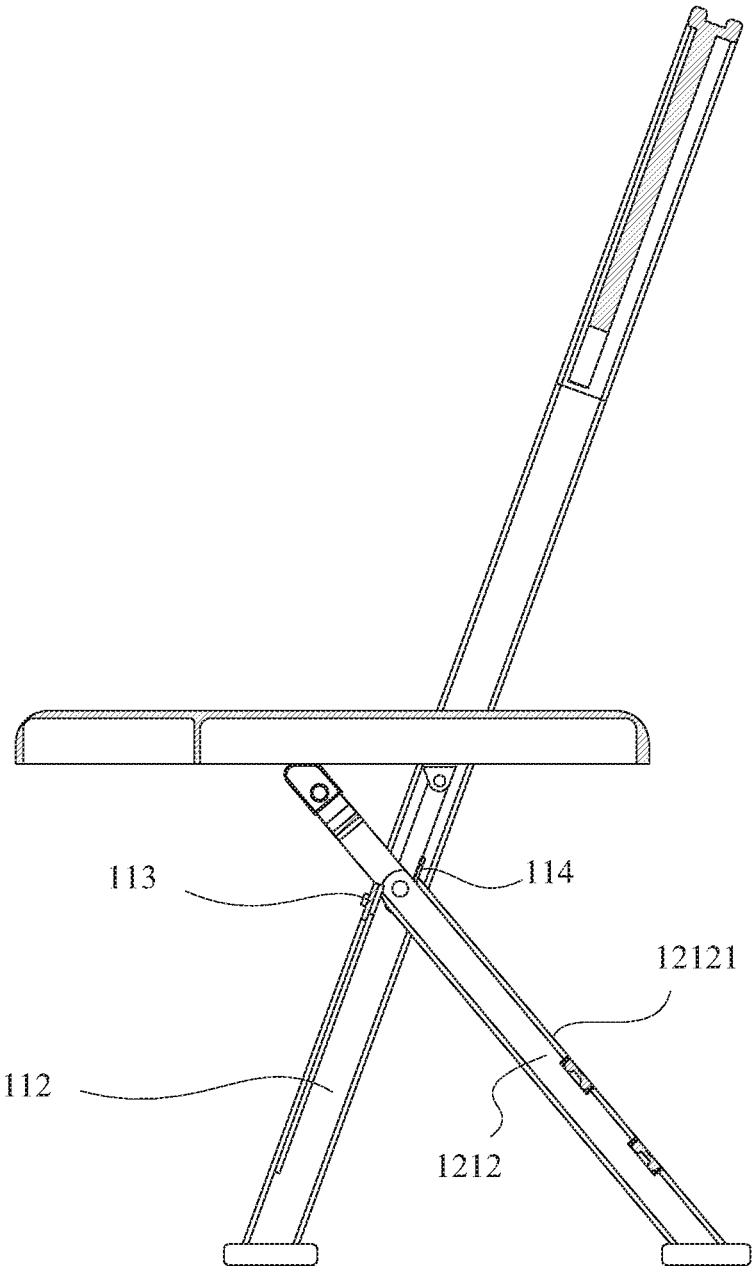
FIG. 7 is a fragmentary cross sectional side view of the foldable chair with a metal of the present invention.

Referring to FIGS. 1-7, wherein FIG. 1 is a perspective view of a foldable chair with a metal seat of the present invention; FIG. 2 is a perspective view of the foldable chair with a metal seat of the present invention viewed from another angle; FIG. 3 is an exploded view of the foldable chair with a metal seat of the present invention; FIG. 4 is a bottom view of the foldable chair with a metal seat of the present invention; FIG. 5A is a fragmentary side view of the foldable chair with a metal seat of the present invention; FIG. 5B is a cross section view of the foldable chair with a metal seat of the present invention taken along Line A-A in FIG. 5A; FIG. 6 is a fragmentary view of the foldable chair with a metal seat of the present invention, illustrating relationship between a bottom edge of a seat and top end of rear legs employed therein; and FIG. 7 is a fragmentary cross sectional side view of the foldable chair with a metal seat of the present invention. As shown, a foldable chair with seat strengthening means according to the present invention includes a chair body 10, a backrest 20 and a seat 30.

Figure 10:
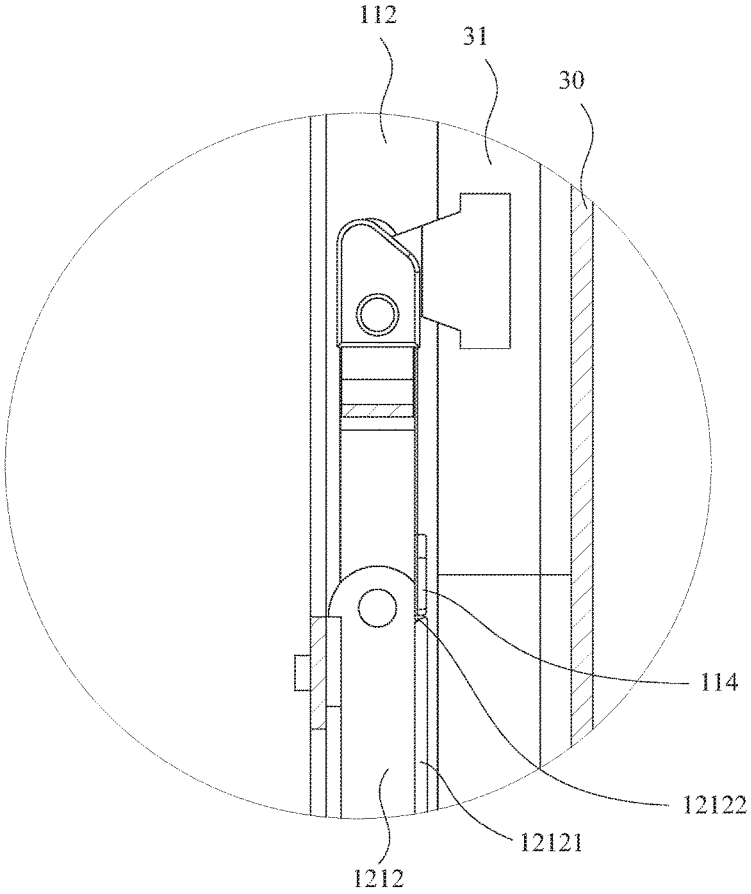
FIG. 10 is an enlarged view illustrating the relationship between the seat and the rear legs of the foldable chair with a metal seat of the present invention in a fully folded position.

The chair body 10 includes a first frame 11 and a second frame 12. The first frame 11 has an inverted U-shaped frame part 111 and two front legs 112 extending from two ends of the inverted U-shaped frame part 111. The second frame 12 has two rear legs 121 connected pivotally to inner sides of the two front legs 112 such that the rear legs 121 are foldable relative to the front legs 112 between a stretch-out position (where the front and rear legs 112, 121 are stretched out as best shown in FIGS. 1 and 7) and a folded position (where the front and rear legs 112, 121 are folded on each other as best shown in FIG. 10). To be more specific, each of the rear legs 121 includes a lower leg support portion 1212, an upper leg support portion 1211 disposed on an outer side of the lower leg support portion 1212 and extending upwardly therefrom for pivotally connecting with the inner side of a respective one of the front legs 112, a reinforcing structure 1213 disposed on an inner side of the upper leg support portion 1211 and having a top end flush with a top end of the upper leg support portion 1211, and a buffering pad 1214 enclosing the top ends of the reinforcing structure 1213 and the upper leg support portion 1211, thereby defining a top end of the rear leg 121 (see FIGS. 1, 2, 5A and 5B). At this time, the reinforcing structure 1213 and the upper leg support portion 1211 are located on both sides of a middle line L1 defined by the buffering pad 1214 while an outer side of the reinforcing structure 1213 abuts against the inner side of the upper leg support portion 1211 such that the middle line L1 of the buffering pad 1214 serves as an imaginary middle line L1 of the top end of the rear legs 121, as best shown in FIGS. 5B and 6. Note that the imaginary middle line L1 extends the front and rear directions of the rear leg 121. The second frame 12 further includes a connection rod 122 connected integrally to the two reinforcing structures 1213, as best shown in FIG. 2.

The backrest 20 is installed to inner sides of the inverted U-shaped frame part 111 of the first frame 11, as best shown in FIG. 1.

The seat 30 is rectangular in shape, is fabricated from metal plate, is connected pivotally to inner sides of the front legs 112 and is movable relative to the first frame 11 between a seated position, where a person can sit thereon (see FIG. 1), and a storage position, where the seat 30 is folded on the first frame 11 (see FIGS. 8 and 10), wherein the top end of the rear leg 121 defines the imaginary middle line L1 in the front and rear direction thereof and wherein the seat 30 has a bottom edge 31 with a width (thickness) smaller than that of the top end of a respective one of the rear legs 121 such that when the seat 30 is moved to the seated position and once the rear legs 121 are at the stretch-out position, the bottom edge 31 of the seat 30 is seated on the top ends of the rear legs 121 and defines a straight line in alignment with the imaginary middle line L1 of the top end of the rear leg 121. Referring to FIGS. 4-6 and to be more specific, the bottom edge 31 extends downward from a periphery confining the seat 30 and has two parallel sides bent inwardly relative to the seat 30 so as to form two curl structures 311 such that when the seat 30 is moved to the seated position and when the rear legs 121 are at the stretch-out position, the curl structures 311 of the seat 30 are seated on the top ends of the rear legs 121 and defining the straight line in alignment with the imaginary middle line L1 of the top end of the rear leg 121. In other words, the gravity weight of the seat 30 is distributed uniformly on the top ends of the rear legs 121 such that even if an overweight person is seated on the seat 30, the rear legs 121 does not deform or break up easily.

In addition, due to presence of two reinforcing structures 1213, half of the total weight of the seat 30 is concentrated on the upper leg support portion 1211 and the reinforcing structures 1213. To be more specific, the gravity center of a seated person on the seat 30 biases toward one side of the seat 30, where one reinforcing structure 1213 transfers a portion weight of the seated person via the connection rod 122 and the other reinforcing structure 1213 toward the upper leg support portions 1211 of the rear legs 121, thereby eliminating the problem of concentration full weight on a single upper leg support portion 1211.

The foldable chair with a metal seat of the present invention further includes an integrally-formed strengthening structure 40 and extending transversely between the two parallel sides of the bottom edge 31 of the seat 30. To be more specific and referring to FIGS. 2, 4 and 5B, the strengthening structure 40 includes a connecting part 41 extending between the two parallel sides of the bottom edge 31 of the seat 30 and located proximate to a front part of the seat 30, two curved parts 42 extending from two opposite ends of the connecting part 41 and two extension parts 43 extending rearward from the two curved parts 42 into the two curl structures 311 respectively such that the extension parts 43 are located above and within the curl structures 311, thereby strengthening rigidity of the seat 30. In other words, the seat 30 as well as the rear legs 121 are strengthened in such a manner to prevent from breaking up or deforming. Preferably, the connecting part 41 of the strengthening structure 40 is spaced apart the front part of the seat 30 by a first distance D1 while a rear part of the seat 30 is spaced apart from the connecting part 41 of the strengthening structure 40 by a second distance D2, where the first distance D1 is greater than the second distance D2. To be more specific, the first distance D1 is equivalent to a quarter of the second distance D2.

Figure 8:
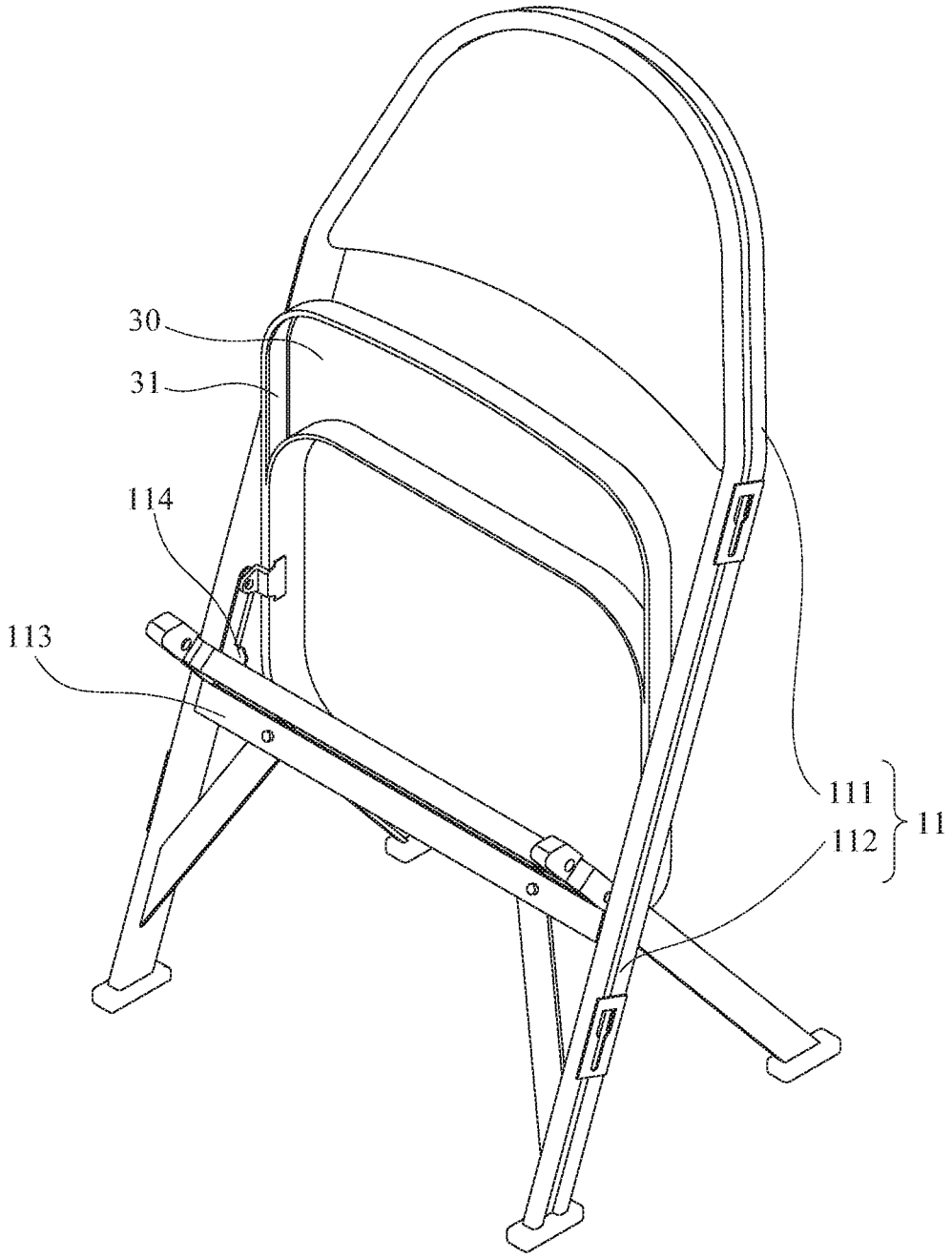
FIG. 8 is a perspective view of the foldable chair with a metal seat of the present invention in a partially folded position.
Figure 9:
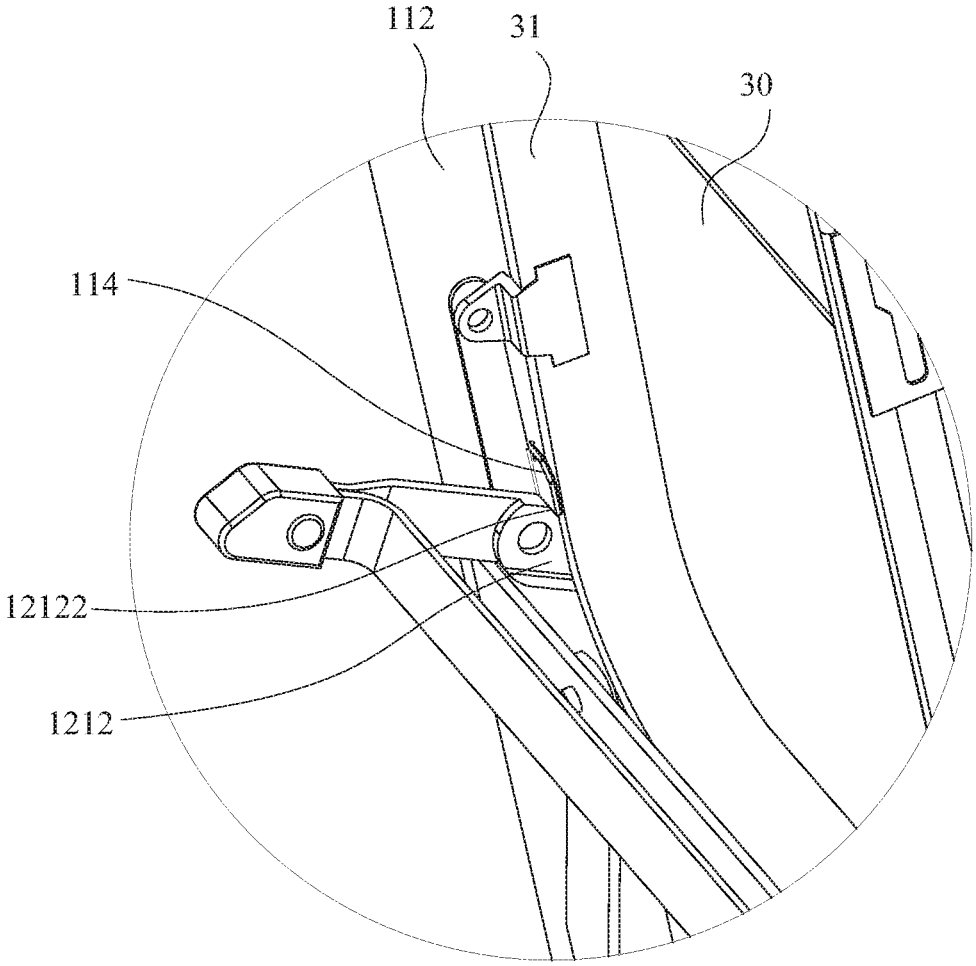
FIG. 9 is an enlarged view illustrating the relationship between the seat and the rear legs of the foldable chair with a metal seat of the present invention in a partially folded position.

In addition, the first frame 11 of the foldable chair with a metal seat of the present invention further has a position restriction rod 113 connected integrally to the two front legs 112 and two stop stubs 114 connected integrally to the two front legs 112 at inner sides thereof (see FIGS. 3, 7 and 10) such that when the seat 30 is moved to the seated position and when the rear legs 121 are at the stretch-out position, the lower leg support portion 1212 leans against the position restriction rod 113 (see FIGS. 1 and 7), and when the seat 30 is moved to the storage position and when the rear legs 121 are moved to the folded position, the bottom edge 31 of the seat 30 and the lower leg support portion 1212 simultaneously perpendicularly abut against the stop stubs 114 of the front legs 112 (see FIGS. 8 and 10). Preferably, the lower leg support portions 1212 of the rear legs 121 are formed with two protrusions 12121 formed with two stub grooves 12122 respectively for receiving the stop stubs 114 of the front legs 112.

Although the present invention has been described with reference to the preferred embodiments thereof, it is apparent to those skilled in the art that a variety of modifications and changes may be made without departing from the scope of the present invention, which is intended to be defined by the appended claims.

What is claimed is:

1. A foldable chair with a metal seat, comprising:

a chair body including a first frame having an inverted U-shaped frame part and two front legs extending from two ends of said inverted U-shaped frame part, and a second frame having two rear legs connected pivotally to inner sides of said two front legs such that said rear legs are foldable relative to said front legs between a stretch-out position, where the front and rear legs are stretched out and a folded position, where the front and rear legs are folded on each other;

a backrest installed to inner sides of said inverted U-shaped frame part;

a seat, made from metal, connected pivotally to said inner sides of said front legs and movable relative to said first frame between a seated position, where a person can sit thereon, and a storage position, where the seat is folded on the first frame, wherein a top end of each of said rear legs defines a first center line extending in the front and rear direction and wherein said seat has a bottom edge, said bottom edge of said seat extends downward from a periphery confining said seat and has two parallel sides bent inwardly relative to said seat so as to form two curl structures, each of which with a width smaller than that of said top end of a respective one of said rear legs such that when said seat is moved to said seated position and once said rear legs are at said stretch-out position, bottom ends of said curl structures of said seat are seated respectively on said top ends of said rear legs and each of which defines a second center line extending in the front and rear direction and aligned with said first center line of a respective one of said top end of said rear legs;

wherein each of said rear legs includes a lower leg support portion, an upper leg support portion disposed on an outer side of said lower leg support portion and extending upwardly therefrom for pivotally connecting with said inner side of a respective one of said front legs, a reinforcing structure disposed on an inner side of said upper leg support portion and having a top end flush with a top end of said upper leg support portion, and a buffering pad enclosing said top ends of said reinforcing structure and said upper leg support portion, thereby defining said top end of said rear leg such that said reinforcing structure and said upper leg support portion are located on both sides of a center line defined by said buffering pad while an outer side of said reinforcing structure abuts against said inner side of said upper leg support portion such that said center line of said buffering pad serves as said first center line of said top end of each of said rear legs.

2. The foldable chair with a metal seat according to claim 1, further comprising an integrally-formed strengthening structure and extending transversely between said two parallel sides of said bottom edge of said seat.

3. The foldable chair with a metal seat according to claim 2, wherein said strengthening structure includes a connecting part extending between said two parallel sides of said bottom edge of said seat and located proximate to a front part of said seat, two curved parts extending from two opposite ends of said connecting part and two extension parts extending rearward from said two curved parts into said two curl structures respectively such that said extension parts are located above and within said curl structures, thereby strengthening the rigidity of said seat.

4. The foldable chair with a metal seat according to claim 3, wherein said connecting part of said strengthening structure is spaced apart from said front part of said seat by a first distance while a rear part of said seat is spaced apart from said connecting part of said strengthening structure by a second distance, where the second distance is greater than the first distance.

5. The foldable chair with a metal seat according to claim 4, wherein the first distance is equal to a quarter of the second distance.

6. The foldable chair with a metal seat according to claim 1, wherein said first frame further has a position restriction rod connected integrally to said two front legs and two stop stubs connected integrally to said two front legs at inner sides thereof such that when said seat is moved to said seated position and when said rear legs are at said stretch-out position, said lower leg support portion leans against said position restriction rod, and when said seat is moved to said storage position and when said rear legs are moved to said folded position, said two parallel sides of said bottom edge of said seat and said lower leg support portion simultaneously perpendicularly abut against said stop stubs of said front legs.

7. The foldable chair with a metal seat according to claim 6, wherein said lower leg support portion is formed with two protrusions having two stub grooves respectively for receiving said stop stubs of said front legs.

8. The foldable chair with a metal seat according to claim 1, wherein said second frame further includes a connection rod connected integrally to said two reinforcing structures.

* * * * *